US006942404B1

(12) United States Patent
Demarchi

(10) Patent No.: US 6,942,404 B1
(45) Date of Patent: Sep. 13, 2005

(54) MARKER TUBING PROCESSING METHODS AND APPARATUS

(76) Inventor: Michael Demarchi, 33 Joy La., Fishersville, VA (US) 22939

( * ) Notice: Subject to any disclaimer, the term of this patent is extended or adjusted under 35 U.S.C. 154(b) by 0 days.

(21) Appl. No.: 10/320,138

(22) Filed: Dec. 16, 2002

Related U.S. Application Data

(60) Provisional application No. 60/341,374, filed on Dec. 17, 2001.

(51) Int. Cl.[7] ..... B41J 11/26; B41J 5/30; B41J 21/17; B41J 11/44; B41F 1/54

(52) U.S. Cl. ..... 400/621; 400/61; 400/70; 400/76; 101/484; 101/226; 101/211

(58) Field of Search ..... 400/621, 484, 400/61, 70, 76, 583, 613; 101/484, 226, 211; 83/74, 72; 347/19, 23

(56) References Cited

U.S. PATENT DOCUMENTS 4,781,090 A * 11/1988 Feldkamper et al. ..... 83/74
4,957,381 A * 9/1990 Sakai et al. ..... 400/621
5,001,500 A * 3/1991 Wolfberg et al. ..... 347/118
5,113,757 A * 5/1992 Spencer ..... 101/35
5,360,213 A * 11/1994 Crowley et al. ..... 270/39.05
5,458,033 A * 10/1995 Wierschke ..... 83/104
5,458,062 A * 10/1995 Goldberg et al. ..... 101/485
5,605,730 A * 2/1997 Treleaven ..... 428/40.1
5,628,574 A * 5/1997 Crowley ..... 400/621
5,659,538 A * 8/1997 Stuebe et al. ..... 700/124
5,777,879 A * 7/1998 Sommerfeldt ..... 700/125
5,797,305 A * 8/1998 Harrod et al. ..... 83/37
5,802,974 A * 9/1998 McNeil ..... 101/226
5,839,688 A * 11/1998 Hertel et al. ..... 242/523.1
5,847,742 A * 12/1998 Nishimura ..... 347/173
5,899,128 A * 5/1999 Smithe et al. ..... 83/76
5,941,053 A * 8/1999 Kotsiopoulos ..... 53/435
5,992,973 A * 11/1999 Wen ..... 347/43
6,010,090 A * 1/2000 Bushmaker et al. ..... 242/526.1
6,030,496 A * 2/2000 Baggot et al. ..... 162/111
6,147,319 A * 11/2000 Imai et al. ..... 219/121.62
6,160,609 A * 12/2000 Inoue ..... 355/41
6,277,224 B1 * 8/2001 Muesch et al. ..... 156/73.3
6,412,902 B2 * 7/2002 Matsumoto et al. ..... 347/19
6,440,268 B1 * 8/2002 Baggot et al. ..... 162/118
6,520,080 B1 * 2/2003 Fried ..... 101/227
6,633,740 B2 * 10/2003 Estabrooks ..... 399/384
2002/0001417 A1 * 1/2002 Mortita ..... 382/284

* cited by examiner

*Primary Examiner*—Daniel J. Colilla
*Assistant Examiner*—Wasseem H. Hamdan
(74) *Attorney, Agent, or Firm*—Jagtian & Guttag

(57) ABSTRACT

A processing system according to the present invention includes a printer that receives unprocessed marker tubing stock (i.e., multiple rows of uncut and unprinted tubing mounted on a carrier) for simultaneous printing of the marker tubing and the carrier with a single print head. A cutting device is configured to sever the marker tubing rows into sections, regardless of the width of the tubing and regardless of whether there are two rows or four rows of tubing. Since the tubing has its longitudinal axes aligned with a longitudinal axis of the carrier, activation of the cutting device can be controlled to sever sections of marker tubing in varying customized widths. In the same cutting stroke, the carrier can be scored or perforated ("perfed"). A rewinder or the like then takes up the severed and perfed stock.

16 Claims, 5 Drawing Sheets

MARKER TUBING PROCESSING METHODS AND APPARATUS

The present invention relates to methods and apparatus for processing marker tubing, and, more particularly, to methods and apparatus for printing on marker tubing stock and its carrier and separating the printed stock into tubing sections. The present invention claims priority to U.S. provisional application No. 60/341,374 filed Dec. 17, 2001.

BACKGROUND OF THE INVENTION

Heat-shrinkable marker tubing is used in various assemblies and configurations. In exemplary applications, printed marker tubing sections are applied to wires, substrates and other objects and heat-shrinkable for marking the objects.

It is desirable from a processing and inventory standpoint to print identifying indicia on both the marker tubing and the carrier. Typically separate printing processes are required to effect printing on both the marker tubing and a carrier due to the orientation of the marker tubing stock on the carrier and due to the necessarily non-planar configuration of the marker tubing stock mounted on the carrier. As a consequence, typical printing assemblies either require multiple print heads or multiple passes through a single print head.

It is also desirable to enable the marker tubing stock to be severed in varying widths while being maintained on the carrier. In this manner, varying lengths of marker tubing sections can he configured for customized applications.

Typically, tubing sections are pre-cut and mounted to a carrier such that longitudinal axes aligned perpendicular with a carrier longitudinal axis, and customizing lengths of the tubing sections is thus not possible. Moreover, conventional marker tubing stock and carrier arrangements are not easily separable into individual sections.

SUMMARY THE INVENTION

The present invention endeavors to overcome the disadvantages of previous marker tubing processing methods and apparatus.

A processing system according to the present invention includes a printer that receives unprocessed marker tubing stock (i.e., multiple rows of uncut and unprinted tubing mounted on a carrier) for simultaneous printing of the marker tubing and the carrier with a single print head. A cutting device is configured to sever the marker tubing rows into sections, regardless of the width of the tubing and regardless of whether there are two rows or four rows of tubing. Since the tubing has its longitudinal axes aligned with a longitudinal axis of the carrier, activation of the cutting device can be controlled to sever sections of marker tubing in varying customized widths. In the same cutting stroke, the carrier can be scored or perforated ("perfed"). A rewinder or the like then takes up the severed and perfed stock.

In a preferred embodiment of the invention, a carrier assembly for a marker tubing print process includes a substantially planar carrier, and a plurality of marker tubing sections removably secured to the carrier in at least two rows. The marker tubing sections have respective longitudinal axes disposed parallel to a longitudinal axis of the carrier. The plurality of marker tubing sections may be secured to the carrier via an adhesive and may have consistent lengths and/or widths. The carrier is preferably formed of paper, and the plurality of marker tubing sections is entirely disposed on the carrier.

In another exemplary embodiment of the invention, a cutting device for cutting a carrier assembly in a marker tubing print process includes at least one cutting blade aligned with at least one of the two rows of marker tubing sections. The cutting blade is provided with angled side sections that converge toward an apex such that a cut width is dependent on a cut depth. The cutting device may comprise two cutting blades. Moreover, as the apex points in a cutting direction, the cutting device further comprises structure that drives the cutting blade in the cutting direction. A controller communicates with the driving structure representing the cut depth.

In still another exemplary embodiment of the invention, a cutting device for cutting a carrier assembly in a marker tubing print process includes (a) determining a size of the marker tubing sections to be cut, and (b) driving the cutting blade in a cutting direction by a distance determined according to the size of the marker tubing sections and cutting at least the marker tubing sections. Step (b) may be practiced by driving the cutting blade in the cutting direction by a distance determined according to the size of the marker tubing sections, cutting the marker tubing sections, and perfing the carrier. Step (b) may alternatively cut both the marker tubing sections and the carrier.

Step (b) is preferably practiced by driving the cutting blade in the cutting direction by a distance determined according to the size of the marker tubing sections and cutting the marker tubing sections and the carrier. Step (a) may be practiced by determining a width of the marker tubing sections when secured to the carrier, and step (b) is practiced by driving the cutting blade in the cutting direction by a sufficient distance to cut the entire width of the marker tubing sections.

BRIEF DESCRIPTION OF THE INVENTION

These and other aspects and advantages of the invention will be described in detail with reference to the accompanying drawings, in which.

DETAILED DESCRIPTION OF THE INVENTION

While the preferred embodiment of the present invention applies to marker tubing stock, the apparatus and method of the invention could applied to cutting labels or any printable, cuttable material, especially material having at least two non-planar surfaces. For simplicity, the descriptions set forth below refers only to marker tubing stock.

Figure 1:
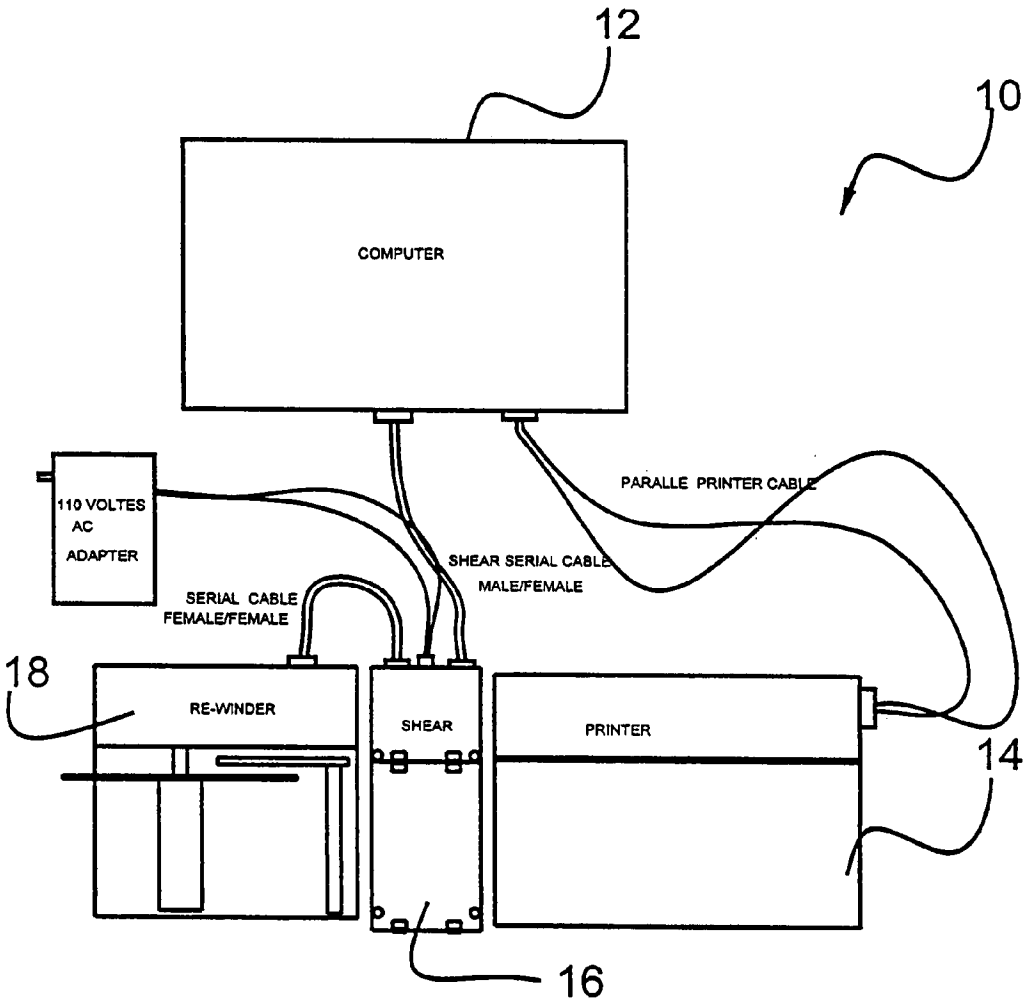
FIG. 1 is a schematic view of the marker tubing processing apparatus components.

The marker tubing processing apparatus 10 according to the invention is illustrated schematically in FIG. 1. A suitably programmed computer 12 communicates with the components of the apparatus 10 to coordinate printing, shearing and winding operations according to operator input parameters. That is, the computer 12 is provided with operator interface structure to receive information from the operator such as the specific data to be printed on the marker tubing sections and the carrier, a desired end-size of the sections, etc. The computer 12 communicates with a printer 14 that effects simultaneous printing on the marker tubing and the carrier, and a cutting device 16 that separates the marker tubing stock into tubing sections while also perfing or cutting the carrier. A rewinder 18 takes up the processed marker tubing sections for subsequent applications. A power source is coupled with the system via an AC adapter 19 or the like.

Figure 2:
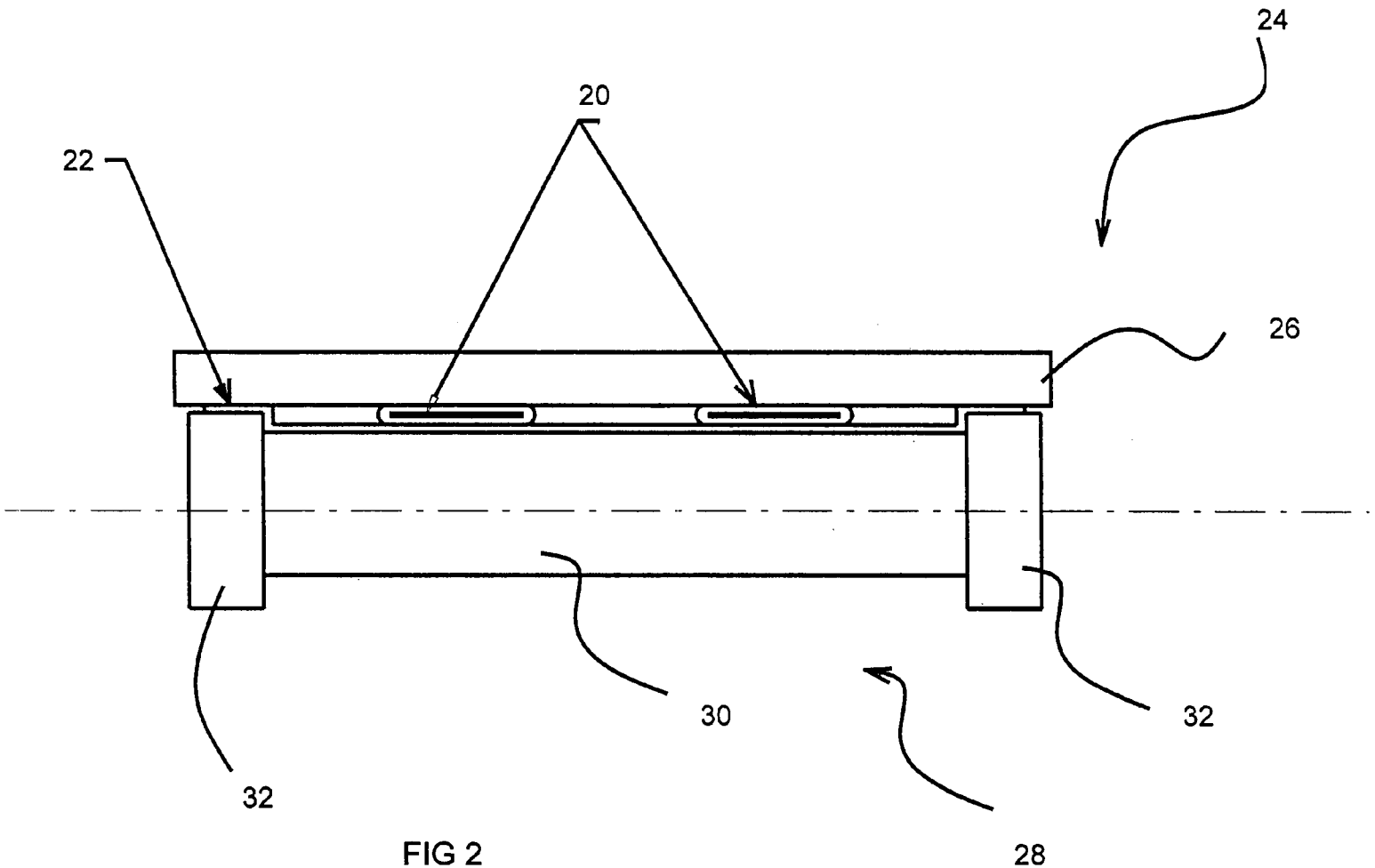
FIG. 2 illustrates the print mechanism of the invention including a modified roller platen.

The marker tubing stock 20 and carrier 22 are fed through the printer 14 in any suitable manner to a print head assembly 24 as shown in FIG. 2. The print head assembly 24 includes a print head 26 that is disposed facing a roller platen 28. The print head 26 is preferably a thermal print head, although any type of print head such as impact, laser, ink jet, etc. may be used.

Figure 5:
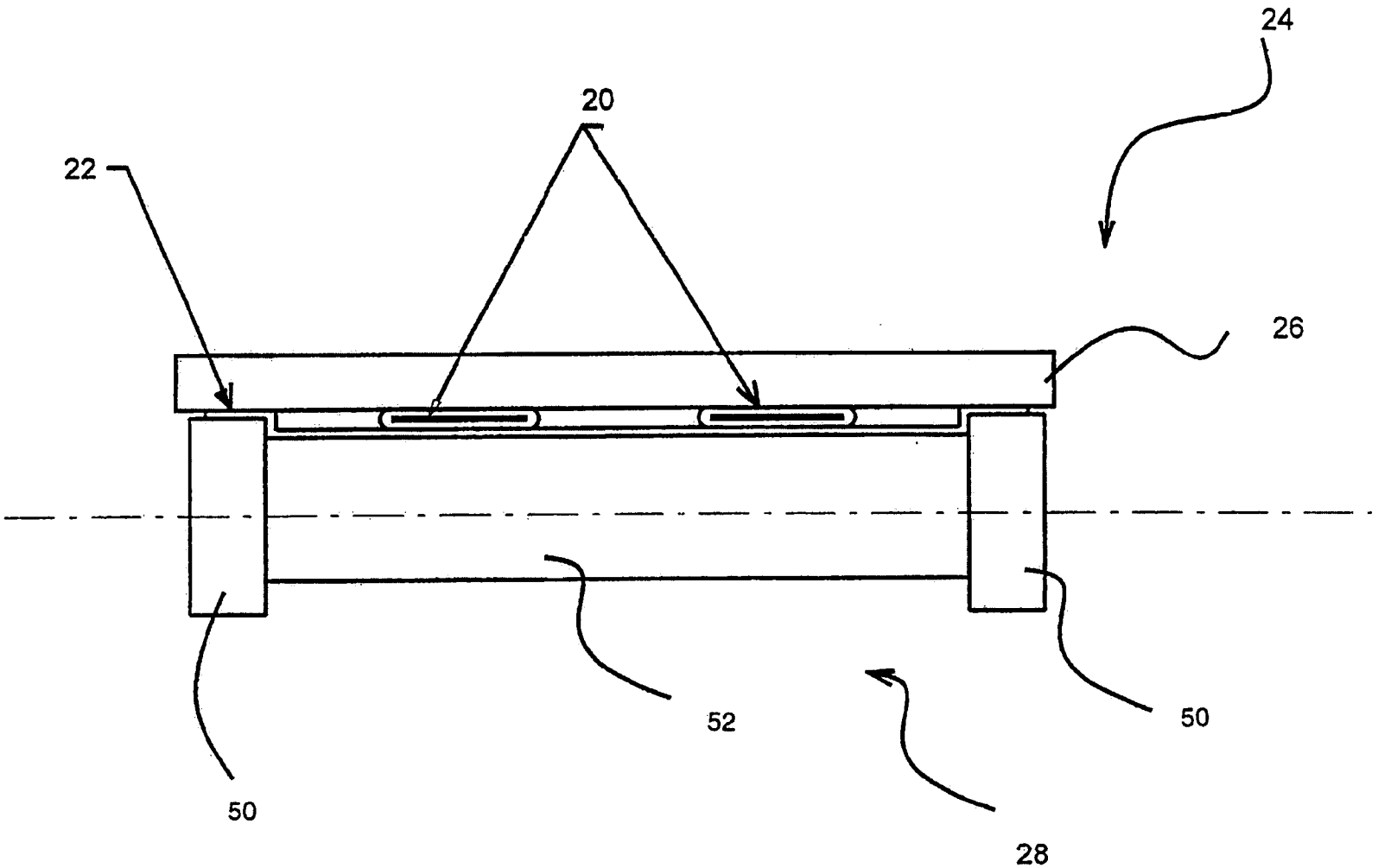
FIG. 5 illustrates the print mechanism of the invention including a modified roller platen having a slip surface smaller in diameter than the drive surface.

The roller platen 28 is rotated with the movement of the carrier 22 and marker tubing stock 20 across the print head 26. As noted above, in conventional arrangements, simultaneous printing on tubing material and its carrier has been impossible due to the non-planar configuration of the timing stock mounted on a carrier. To overcome this problem, the platen 28 according to the invention includes a drive surface 30 and at least one slip surface 32. In the preferred embodiment, platen 28 includes a drive surface 30 is formed of rubber that supports both the carrier 22 and the marker tubing stock 20 as shown and two surrounding slip surfaces 32, having a larger diameter relative to the drive surface, that support the carrier 22 only. In a different embodiment, the drive surface 50 could have a larger diameter relative to the slip surface 52 as shown in FIG. 5.

With the arrangement of the smaller diameter drive surface 30 and the larger diameter slip surfaces 32, the marker tubing stock 20 and the carrier 22 can be positioned in a substantially common plane as the product passes the print head 26. As a consequence, the print head 26 can simultaneously print identifying indicia on both the tubing stock 20 and the carrier 22.

Since the surrounding slip surfaces 32 of the platen roller 28 have a larger diameter than the drive surface 30. The surface speed of the slip surfaces 32 may be undesirably higher than the surface speed of the drive surface 30. To accommodate the different surface speeds, the surrounding slip surfaces 32 must be allowed to slip relative to the drive surface 30. The slip is preferably accomplished either by separating the surrounding surfaces 32 into individual rollers such that the surrounding surfaces 32 can rotate at different speeds than the drive surface 30, or by making the surface friction of the surrounding surfaces 32 much lower than the drive surface 30 to allow the surrounding surfaces 32 to slip relative to the carrier 22. In this context, a non-stick type such as Teflon™ or Kapton™ tape may be wrapped on the roller. With this arrangement, the platen roller 28 can be formed integrally of one piece with the larger diameter surrounding surfaces 32 wrapped with the non-stick tape.

As shown in FIG. 2, the relative sizes of the drive surface 30 and surrounding surfaces 32 are primarily dependent on the thickness of the marker tubing stock 20, although a slight tolerance and the pliability of the marker tubing stock 20 enable a single configuration to process a range of marker tubing stock widths.

Figure 4:
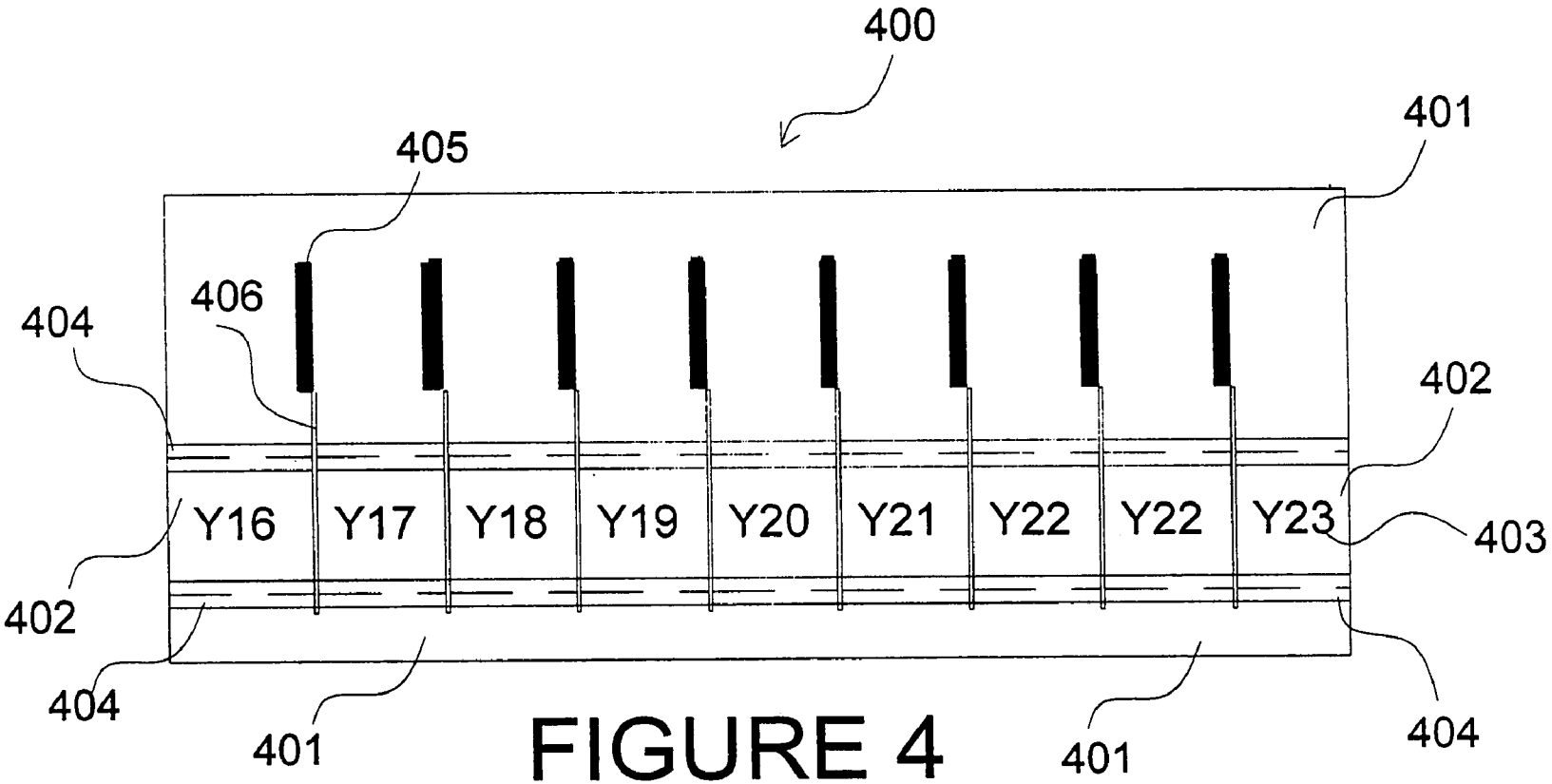
FIG. 4 is a schematic view of a printed marker tubing stock attached to a carrier with top of form marks printed on the carrier.

In the printing process as shown in FIG. 4, the print head 26 simultaneously effects printing of top of form marks 405 on either or both of the marker tubing stock 402 and the carrier 401 according to the parameters input by the operator via the computer 12. Additionally, the computer can print other information such as text 403 on the tubing stock. The top of form marks indicate where the marker tubing stock is to be cut by the cutting device. The cut slits 406 are depicted in FIG. 4. Accordingly, the distance between the top of form marks indicates the length of each section of marker tubing stock.

Figure 3:
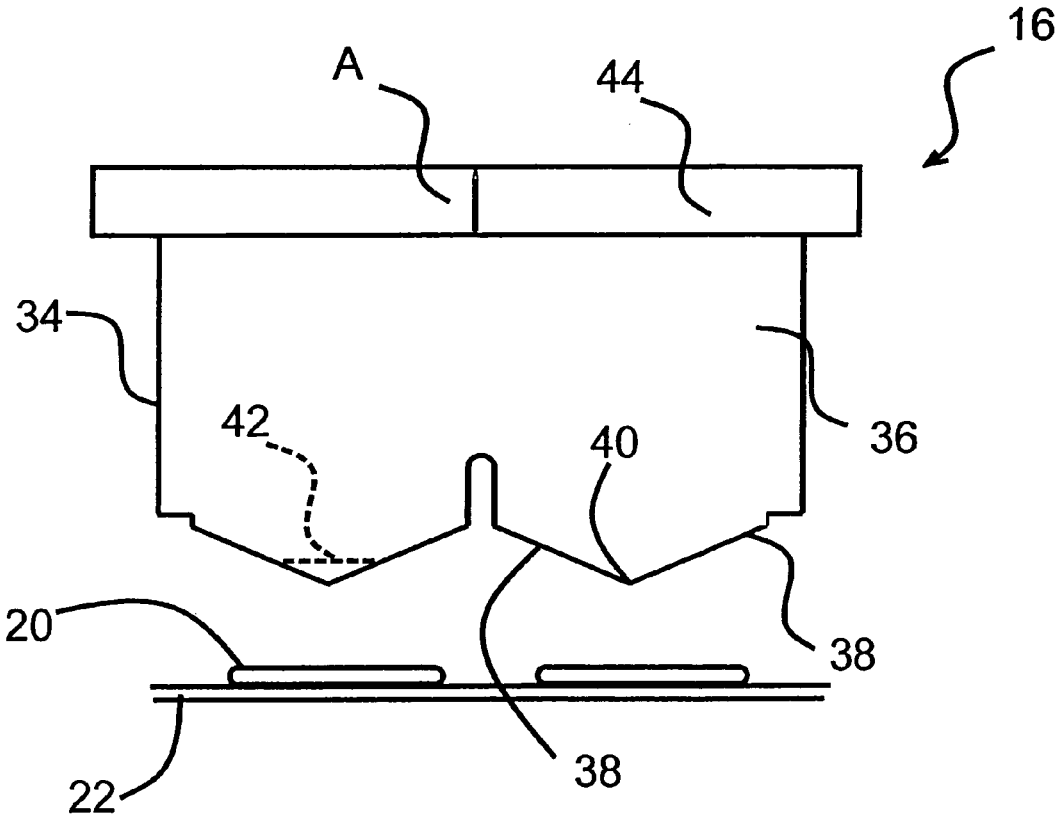
FIG. 3 is a side view of a side view of a cutting blade for the shearing mechanism of FIG. 1.

The printed tubing stock 20 and carrier 22 are then fed to the cutting device 16 to be cut into marker tubing sections. In this context, however, the system can be readily configured such that the printer and cutting device locations are reversed. With reference to FIG. 3, the cutting device 16 includes a sensing mechanism (not shown) that recognizes the top of form marks and at least one cutting blade 36 aligned with a corresponding rows of marker tubing stock 20. Two cutting blades 36 are actually shown in FIG. 3. The cutting blades 36 each include angled side sections 38 that converge toward an apex 40. The angled side sections 38 of the blades 36, as an alternative to the embodiment illustrated in FIG. 3, may be truncated such that the blades 36 terminate in a flat surface 42 (shown in phantom) that is substantially parallel to the carrier 22.

The cutting blade 34 is coupled with a driving apparatus 44 that drives the cutting device 34 in a substantially vertical orientation in cutting direction as shown by arrow A in FIG. 3. The driving direction of the driving apparatus 44 corresponds to a direction in which the apex 40 of the blade side sections 38 points. The driving apparatus 44 can be configured with any suitable construction to effect reciprocal motion of the cutting device 34. For example, a rotating cam or the like can be used to effect linear reciprocal motion of the cutting device, or a direct linear driving apparatus such as a piston or the like could also be used. Any suitable driving construction can be used provided that a driving distance can be readily controlled.

In this context, the sensing mechanism relays the driving mechanism the location of the top of form marks and the the driving mechanism drives the cutting blade to cut the marker tubing at these marks. The computer 12 controls the driving distance of the cutting device 34 according to a desired cutting depth of the blades 36, which cutting depth is based on a width and thickness of the marker tubing stock 20 mounted on the carrier 22. Because of the angled side sections of the cutting blades 36, the cut width by the cutting device 16 is dependent on the cut depth. That is, the deeper the cutting blades 36 are driven into the marker tubing stock 20, the wider the cut will be. The computer 12 is thus programmed to communicate an appropriate signal to the driving device 44 based on an operator indication of the type (i.e., size, thickness. etc.) of tubing stock 20 being processed. Moreover, because a longitudinal axis of the tubing stock 20 is parallel to a moving direction of the carrier 22, the tubing section lengths can be varied and customized according to operator preference.

In the same cutting stroke, by virtue of the angled side sections 38 of the blades 36, the blades 36 perforate the carrier 22 for subsequent separation. In this context, some or the entire blade 36 may include serrated or staggered edges to effect at least partially a discontinuous perforation.

The thus processed marker tubing sections are then fed to the rewinder 18 that takes up the carrier and processed marker tubing sections for subsequent applications.

With the construction of the marker tubing processing apparatus according to the present invention, complete processing of the tubing stock into tubing sections can be achieved in a simple operation. A printer effects simultaneous printing of the tubing stock and carrier, thereby requiring only one print head, and a cutting device severs the tubing stock into custom length sections while perforating the carrier. The resulting processed marker tubing sections can then be readily used for subsequent applications.

With the invention has been described in connection with what is presently considered to be the most practical and preferred embodiments, it is to be understood that the invention is not to be limited to disclosed embodiments, but on the contrary, is intended to cover various modifications and equivalent arrangements included within the spirit and scope of the appended claims.

What is claimed is:

1. A computerized cutting apparatus comprising:

a non-planar surface material printer, said printer receiving and marking at least one non-planar surface material with at least one top of form mark, said printer including a print head disposed facing a roller platen, said roller platen including a drive surface and a slip surface;

a cutting device having a sensing mechanism, said sensing mechanism recognizing said at least one top of form mark, and at least one cutting blade, said cutting blade cutting said material into sections by at least partially cutting said material at each point corresponding to said at least one top of form mark;

a driving device coupled to said cutting device, said driving device driving said cutting device in a cutting direction in relation to said material;

wherein said at least one top of form mark determines the length of each of said sections; and wherein location of each of said top of form marks and driving distance of said cutting device is controlled by a computer.

2. The cutting apparatus of claim 1, wherein said material is at least one marker tubing stock removably attached to a carrier.

3. The cutting apparatus of claim 1, wherein said material is at least one label removably attached to a carrier.

4. The cutting apparatus of claim 1, wherein said material is a marker tubing stock.

5. The cutting apparatus of claim 1, wherein said roller platen includes a drive surface for supporting said at least one material and a slip surface for supporting only one material, said slip surface having a diameter larger than said drive surface.

6. The cutting apparatus of claim 5, wherein said at least one material is at least one marker tubing stock attached to a carrier and said only one material is said carrier.

7. The cutting apparatus of claim 5, wherein said at least one material is a label attached to a carrier and said only one material is said carrier.

8. The cutting apparatus of claim 1, wherein said roller platen includes a drive surface for supporting said at least one material and a slip surface for supporting only one material, said slip surface having a diameter smaller than said drive surface.

9. The cutting apparatus of claim 1, wherein said at least one cutting blade includes at least one angled side section converging to an apex such that a cut width is dependent on a cut depth.

10. The cutting apparatus of claim 9, wherein said apex is flat.

11. The cutting apparatus of claim 1, further comprising a rewinder for receiving said at least one material after being partially cut.

12. The cutting apparatus of claim 1, wherein said printer is a thermal printer.

13. A computerized cutting apparatus comprising:

a non-planar surface material printer, said printer receiving and marking at least one non-planar surface material with at least one top of form mark, said printer including a print head disposed facing a roller platen, said roller platen including a drive surface for supporting said at least one material and a slip surface for supporting only one material, said slip surface having a diameter larger than said drive surface;

a cutting device having a sensing mechanism, said sensing mechanism recognizing said at least one top of form mark, and at least one cutting blade, said cutting blade cutting said material into sections by at least partially cutting said material at each point corresponding to said at least one top of form mark;

a driving device coupled to said cutting device, said driving device driving said cutting device in a cutting direction in relation to said material;

wherein said at least one top of form mark determines the length of each of said sections; and wherein location of each of said top of form marks and driving distance of said cutting device is controlled by a computer.

14. The cutting apparatus of claim 13, wherein said at least one material is at least one marker tubing stock attached to a carrier and said only one material is said carrier.

15. The cutting apparatus of claim 13, wherein said at least one material is a label attached to a carrier and said only one material is said carrier.

16. A computerized cutting apparatus comprising:

a non-planar surface material printer, said printer receiving and marking at least one non-planar surface material with at least one top of form mark, said printer including a print head disposed facing a roller platen, said roller platen including a drive surface for supporting said at least one material and a slip surface for supporting only one material, said slip surface having a diameter smaller than said drive surface;

a cutting device having a sensing mechanism, said sensing mechanism recognizing said at least one top of form mark, and at least one cutting blade, said cutting blade cutting said material into sections by at least partially cutting said material at each point corresponding to said at least one top of form mark;

a driving device coupled to said cutting device, said driving device driving said cutting device in a cutting direction in relation to said material;

wherein said at least one top of form mark determines the length of each of said sections; and wherein location of each of said top of form marks and driving distance of said cutting device is controlled by a computer.

* * * * *